US006255785B1

(12) United States Patent
Yang et al.

(10) Patent No.: US 6,255,785 B1
(45) Date of Patent: Jul. 3, 2001

(54) HIGH POWER FACTOR ELECTRONIC BALLAST WITH LOW LAMP CURRENT PEAK RATIO

(76) Inventors: Changgen Yang, Room 404 No. 19 Kailusicum, Shanghai P. R. (CN), 200438; William Yu, 12310 Herrington Manor Dr., Silver Spring, MD (US) 20904

( * ) Notice: Subject to any disclaimer, the term of this patent is extended or adjusted under 35 U.S.C. 154(b) by 0 days.

(21) Appl. No.: 09/536,986

(22) Filed: Mar. 29, 2000

(30) Foreign Application Priority Data

Oct. 25, 1999 (CN) ..... 99 2 40022

(51) Int. Cl.[7] ..... H05B 41/36
(52) U.S. Cl. ..... 315/291; 315/224; 315/209 R
(58) Field of Search ..... 315/291, 307, 315/224, 225, 209 R, 244, 247, 219, 308, 312, 324, 260

(56) References Cited

U.S. PATENT DOCUMENTS 5,068,573 * 11/1991 Bruning et al. ..... 315/224
5,223,767 * 6/1993 Kulka ..... 315/209 R
5,949,199 * 9/1999 Qian et al. ..... 315/307
6,118,224 * 9/2000 Murakami et al. ..... 315/209 R

* cited by examiner

*Primary Examiner*—Hoanganh Le
*Assistant Examiner*—Wilson Lee
(74) *Attorney, Agent, or Firm*—Dowell & Dowell, P.C.

(57) ABSTRACT

A high power factor electronic ballast for fluorescent lamps having low lamp current peak ratio and which includes a bridge rectifier for rectifying a commercial power supply voltage, a high frequency oscillator using an output voltage from a bridge rectifier as its supply voltage, a first supplementary power source to supply the high frequency oscillator a voltage by superimposing two supplementary voltages generated from a portion of high frequency current in a load on the output voltage from the bridge rectifier, and a second supplementary power source to supply the high frequency oscillator a direct offset voltage generated from a portion of high frequency current in the load to improve the input current waveform of the bridge rectifier.

6 Claims, 5 Drawing Sheets

HIGH POWER FACTOR ELECTRONIC BALLAST WITH LOW LAMP CURRENT PEAK RATIO

BACKGROUND OF THE INVENTION

1. Field of the Invention

The invention relates to a high frequency electronic ballast and particularly to a high power factor electronic ballast with low lamp current peak ratio.

2. Description of Related Art

As is now known in the art, the input power factor of an electronic ballast depends on the distortion of input current thereof. The lower the input current distortion, the higher the input power factor. In the passive type high-power-factor electronic ballasts available today, such as current pursuing type or double pumping type electronic ballasts, their input parameters are out of the range of low distortion requirement in L group standard of IEC 929 and GB/T15144, since their performances are only compliant with H group thereof.

Furthermore, the lamp current peak ratio in current pursuing circuit is larger than 1.7. Thus, the application requiring high power factor with low distortion can not be reached by the electronic ballast described above.

SUMMARY OF THE INVENTION

In view of the above mentioned problems, the object of the invention is to provide a high power factor electronic ballast with low lamp current peak ratio.

The high-power-factor electronic ballast with low lamp current peak ratio according to the invention comprises a bridge rectifier for rectifying the commercial power supply voltage, a high frequency oscillator using the output voltage from the bridge rectifier as its supply voltage, and a first supplementary power source to supply the high frequency oscillator a voltage by superimposing two supplementary voltages generated from a portion of high frequency current in the loads on the output voltage from the bridge rectifier. Further, the electronic ballast comprises a second supplementary power source to supply the high frequency oscillator a direct offset voltage generated from a portion of high frequency current in the load to improve the input current waveform of the bridge rectifier. The second supplementary power source comprises a diode and a capacitor having its one terminal connected to the load terminal, linked with the load and the first supplementary source power, and another terminal connected to the voltage output terminal of the bridge rectifier and linked with one terminal of the diode. The diode is connected serially in a feed branch from the bridge rectifier to the high frequency oscillator with its other terminal connected to the oscillator.

By means of the technical solution according the invention, the purpose of the invention stated above can be attained with simple configuration. In particular, the passive type electronic ballast configured according to the invention has the advantages of low output lamp current peak ratio (<1.7) and high power factor (i.e. with a pf up to 0.97–0.99).

BRIEF DESCRIPTION OF DRAWINGS

For a more complete understanding of the invention and for further features and advantages, description is made below in conjunction with the accompanying drawings, wherein:

FIG. 4(*b*) is an input voltage/current waveform diagram using a second supplementary power source according to the invention.

DETAILED DESCRIPTION OF THE PREFERRED EMBODIMENTS

Figure 1:
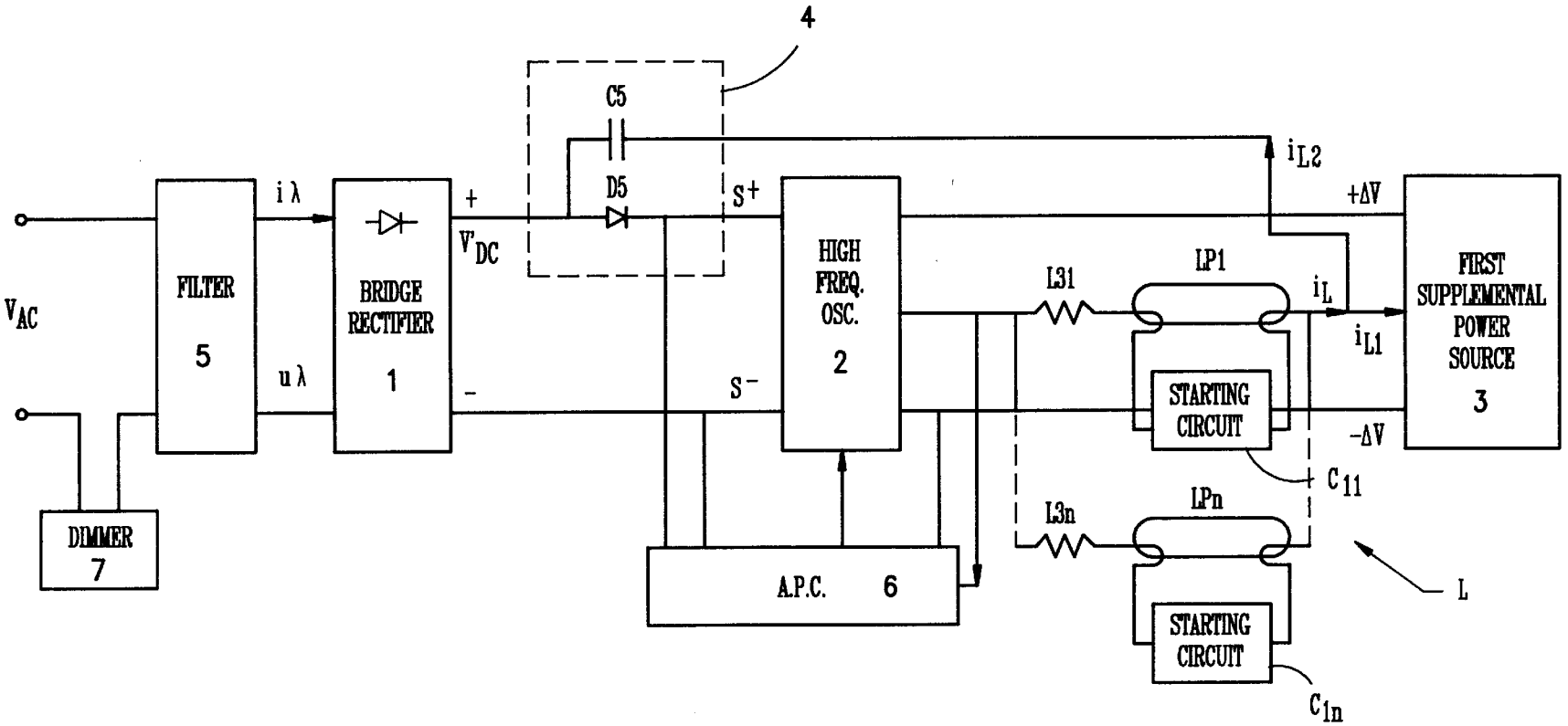
FIG. 1 is a schematic diagram showing the configuration of an embodiment according to the invention.

Now, referring to FIG. 1, a schematic diagram shows the configuration of an embodiment according to the invention characterized by a second supplementary power source 4 given particularly in contrast to the other parts based on prior art and showing in the form of block diagram. As shown in FIG. 1, the high power factor electronic ballast with low lamp current peak ratio D comprises a bridge rectifier 1 for rectifying the commercial power supply voltage VAC, a high frequency oscillator 2 using the output voltage from the bridge rectifier 1 as its supply voltage, and a first supplementary power source 3 to supply the high frequency oscillator 2 a voltage by superimposing two supplementary voltages ±ΔV generated from a portion of high frequency current iL1 in the load L, i.e. the fluorescent lamps Lp1–Lpn, on the output voltage V'DC from bridge rectifier 1. The load L is a single fluorescent lamp branch or a plurality of fluorescent branches in parallel connection. The fluorescent lamp branch is connected between an output terminal of the high frequency oscillator 2 and the load terminal C4 of first supplementary power source 3, and consists of a fluorescent lamp Lp1–Lpn with a ballast inductor L31–L3n connected serially to one of its filaments and a starting circuit C11–C1n connected between its filaments.

The electronic ballast D further comprises a second supplementary power source 4 to supply the frequency oscillator 2 a voltage by superimposing a direct offset voltage generated from another portion of high frequency current L2 in the load L on the output V'DC from bridge rectifier 1 to improve the input current waveform of bridge rectifier 1. The second supplementary power source 4 comprises a diode D5 and a capacitor CS having its one terminal connected to the load terminal C4 linked with the load and the first supplementary power source and the other terminal connected to the plus output terminal "+" of bridge rectifier 1 and linked with the plus terminal of diode D5, the diode D5 being connected serially in the plus feed branch from bridge rectifier 1 to high frequency oscillator 2 with its minus terminal "−" connected to the plus supply terminal S+ of oscillator 2.

In the embodiment described above, the high frequency oscillator 2 is a half-bridge symmetric oscillator, and consists of two n-p-n transistors. When a minus voltage supply is required due to the use of p-n-p transistors in such oscillator or the use of another type oscillator, the minus terminal of diode D5 should be connected to the minus output terminal "−" of bridge rectifier 1, and linked with another terminal of capacitor C5; thus the diode D5 should be connected serially in the minus feed branch from bridge rectifier 1 to high frequency oscillator 2 with its plus terminal connected to the minus supply terminal S− of oscillator 2.

The first supplementary power source 3 feeds a voltage to the high frequency oscillator 2 by superimposing two supplementary voltages ±ΔV generated from a portion of high frequency current iL1 in the load L, i.e. the fluorescent lamp, on the output voltage V'DC from bridge rectifier 1 to improve the peak ratio of high frequency current iL and obtain a peak ratio CFi<1.7. These belong to the field of prior art, and their details are omitted herein.

In addition, there may be a filter 5 between the bridge rectifier 1 and the commercial power input for filtering, isolating and interference protection, and there may be a protection circuit 6 in the output of oscillator 2 to control the oscillator 2 so that the electronic ballast can be safe from abnormal low impedance conditions such as failure to start a fluorescent lamp, rectification effect, or short-circuit of a starter. These features also belong to the field of prior art, and their details are omitted.

The key to the invention lies in an additional second supplementary power source 4 which can improve the output current waveform of bridge rectifier 1 to increase the input power factor.

Figure 4A:
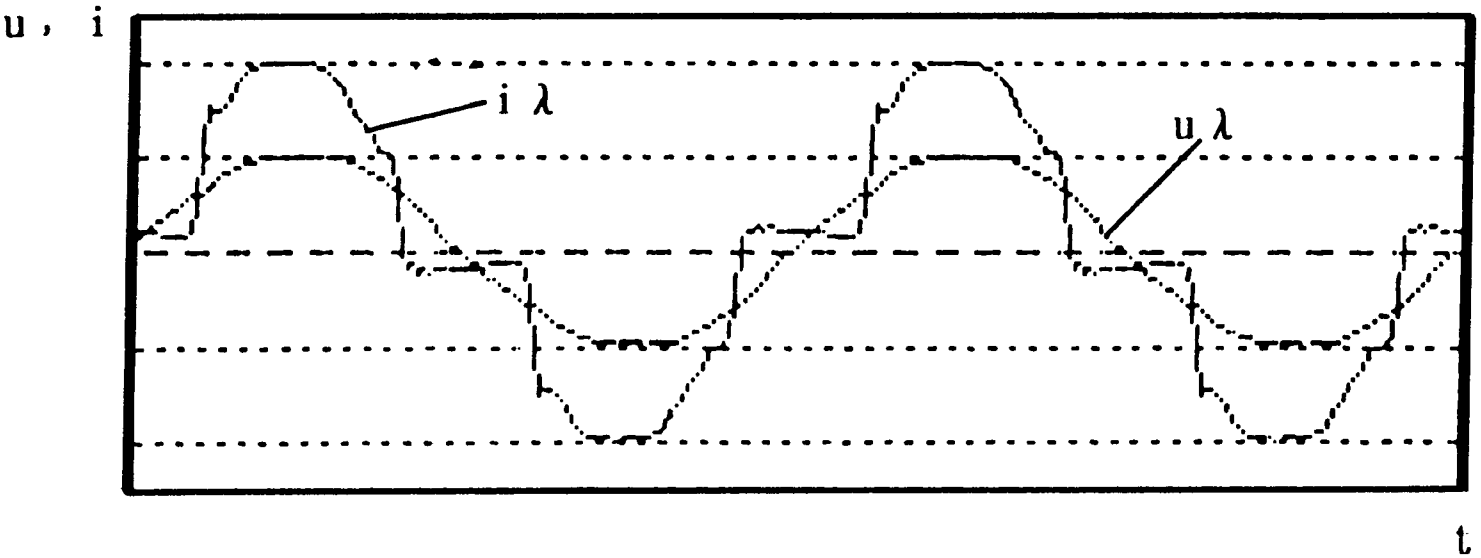
FIG. 4(*a*) a is an input voltage/current waveform diagram without using a second supplementary power source in the previous ballast.
Figure 4B:
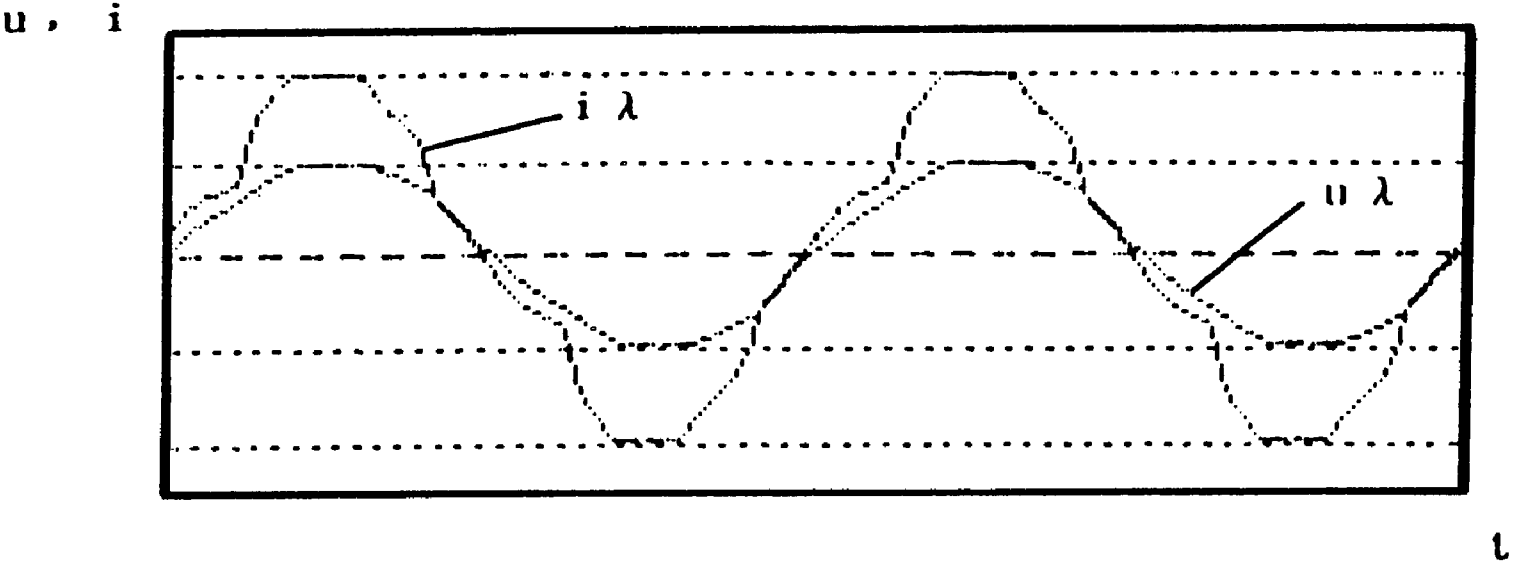

For understanding this advantage, a description will be given in conjunction with FIG. 4(*a*) and FIG. 4(*b*), wherein $\mu\lambda$ is the input voltage of bridge rectifier 1. FIG. 4(*a*) is a waveform diagram of input current/voltage for the bridge rectifier 1 in the case without using the second supplementary power source 4, showing a severe distortion sine wave of input current iλ with 25 to 30° interruption and it's phases 0°, 180°, . . . and others.

For this input current waveform, after an analysis and integration on it, we may obtain merely a power factor Pf in the range of 0.93–0.95, and a total harmonic distortion (THD) in the order of 0.3, wherein the 3rd harmonic is below 0.37λ, but in the range of 0.28λ–0.34λ; thus only the H group requirements can be met.

On the other hand, as shown in FIG. 4(*b*), the waveform of input current iλ for rectifier 1 is improved due to the use of a second supplementary power source 4 according to the invention. By means of the capacitor C5 in second supplementary power source 4, a portion of high frequency lamp current at the load terminal (i.e. one terminal of the fluorescent lamp) feeds back to the output of the bridge rectifier, and rectifies by the diode D5 to produce a small direct offset voltage at the interruption point of iλ so that the DC supply is increased, and the peak ratio is reduced (an offset voltage in the order of 20–25 V can be produced by the second supplementary power source 4 when Uλ=200 V). In the mean while, an equivalent positive current seen from the input of second supplementary power source, wherein a reverse current is fed by the rectifier 1 during the negative-half cycle of lamp current, can be obtained. Accordingly, the interruptions of input current iλ is eliminated such that its waveform is improved with a higher power factor Pf up to 0.97–0.99, THD<20%, 3rd<30% of pf, 5rd<7%, 9rd<3%, 11–39rd<2%. Therefore, the electronic ballast according to the invention is complaint with L group requirements.

Then, referring back to FIG. 1, the total electronic ballast D corresponds to a "pure resistor" seen from the input terminal of bridge rectifier 1 due to the effect of second supplementary power source 4; thus with such a ballast D and a conventional thyristor incandescent lamp lighting controller 7 connected to the commercial power, a lighting adjustable electronic ballast can be made, and the flash of fluorescent lamp during adjustment can be eliminated.

Figure 2:
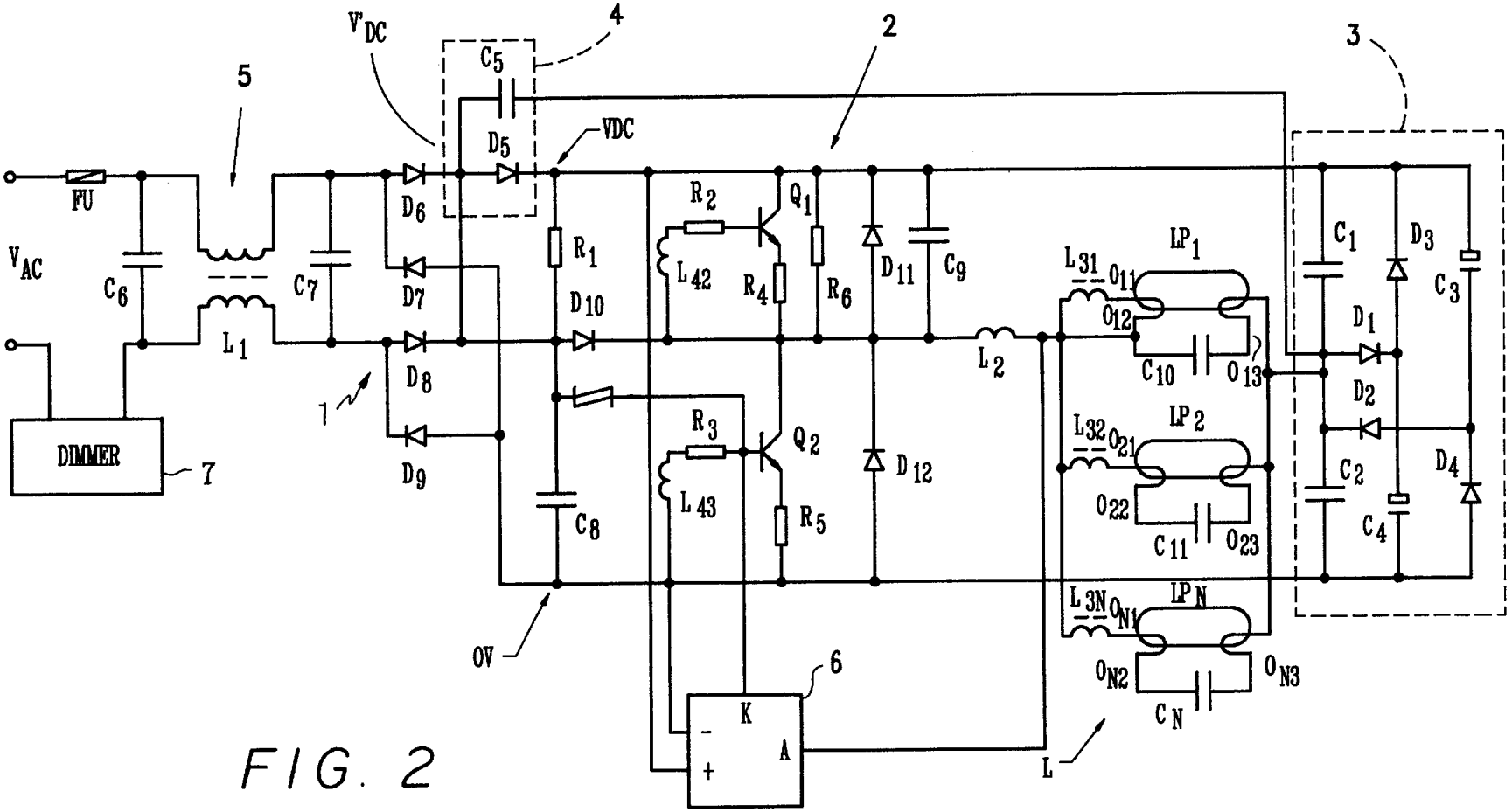
FIG. 2 is a circuit diagram showing particularly a configuration of the embodiment according to the invention.

Referring to FIG. 2, the circuit diagram of an embodiment according to the invention is particularly shown, wherein the filter 5 in FIG. 1 consists of a mutual-inductance element L, a capacitor C6 and C7; the bridge rectifier 1 consists of the diodes D6–D9; the high frequency oscillator 2 consists of the transistors Q1, Q2, the diodes D10–D12, the inductances L2, L42, L43, L31–L3n and the capacitors C8–C9; the fluorescent lamps Lp1–Lpn are the loads of electronic ballast; the first supplementary power 3 consists of the capacitors C1–4, the diodes D1–D4; and the second supplementary power source 4 consists of a capacitor C5 and a diode D5.

Figure 3:
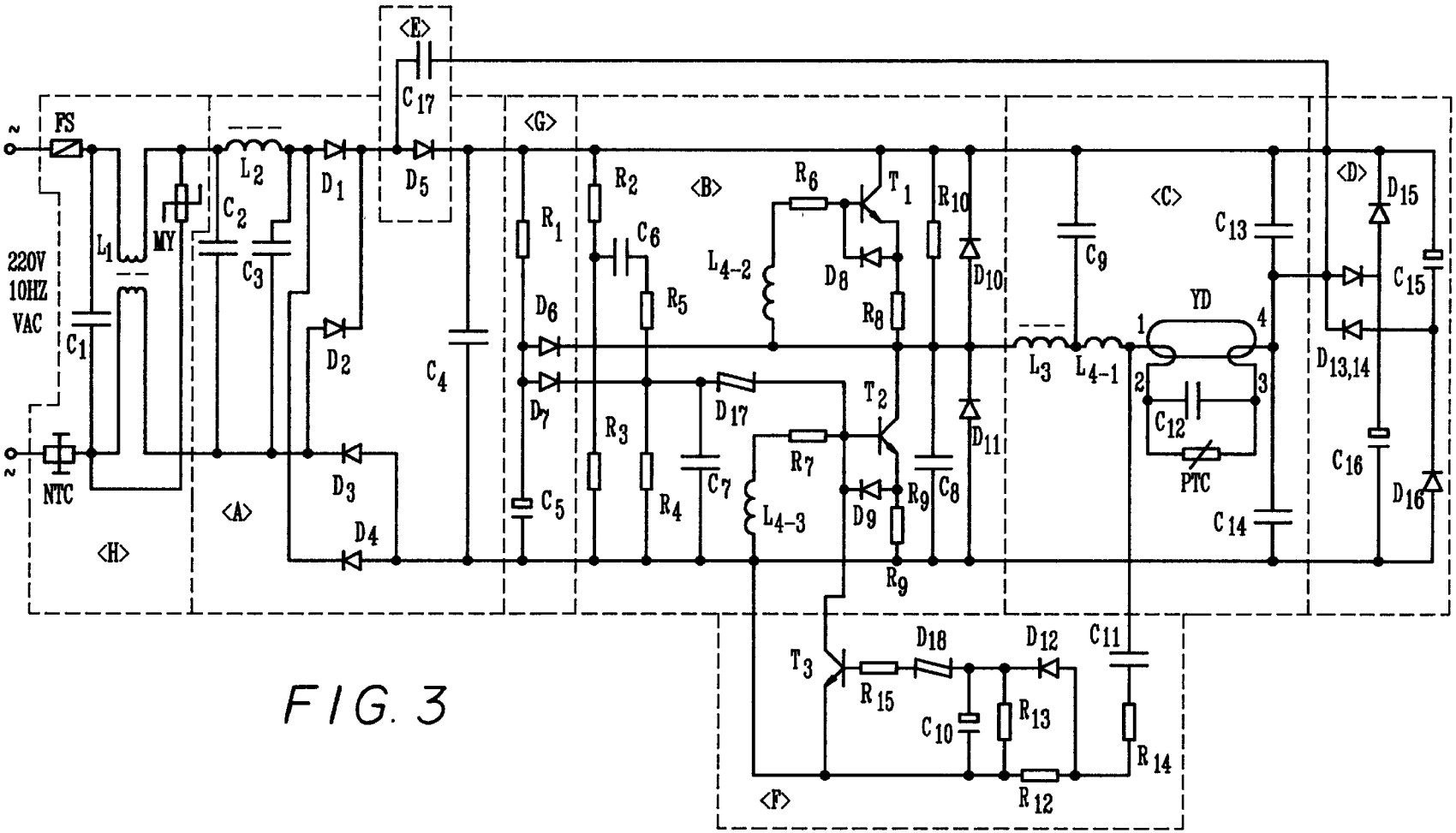
FIG. 3 is a circuit diagram showing particularly another configuration of the embodiment according to the invention.

Referring to FIG. 3, another circuit diagram of the electronic ballast according to invention is given, wherein the failure protection circuit 6 in FIG. 1 consists of a transistor T3, diode D12, a triggering diode D18, the resistors R12–R15, and the capacitors C10–C11.

As shown in FIG. 2 and FIG. 3, various changes can be made for the implementation of circuits with know arts, and therefore the invention can not be limited by a particular circuit. It is intended that the scope of an electronic ballast according to the invention should only be limited by the appended claims.

We claim:

1. A high power factor electronic ballast with low lamp current peak ratio comprising; a bridge rectifier for rectifying a commercial power supply voltage, a high frequency oscillator using an output voltage from said bridge rectifier as its supply voltage, and a first supplementary power source to supply said high frequency oscillator a voltage by superimposing two supplementary voltages generated from a portion of high frequency current in a load on said output voltage from said bridge rectifier a second supplementary power source to supply said high frequency oscillator a direct offset voltage generated from a portion of high frequency current in the load to improve an input current waveform of said bridge rectifier, said second supplementary power source including a diode and a capacitor having its one terminal connected to a load terminal linked with the load and said first supplementary source power and another terminal connected to a voltage output terminal of said bridge rectifier and linked with one terminal of said diode, said diode being connected serially in a feed branch from said bridge rectifier to said high frequency oscillator with said another terminal connected to said oscillator.

2. The electronic ballast with low lamp current peak ratio set forth in claim 1 in combination with at least one fluorescent lamp branch, said at least one fluorescent lamp branch including a fluorescent lamp with one filament terminal connected in series with a ballast inductor and a starter circuit shunted across two filament terminals of said lamp.

3. The electronic ballast set forth in claim 2, wherein the ballast further comprises a filter connected between the commercial power input and said rectifier for filtering and isolating.

4. The electronic ballast set forth in claim 3, wherein said ballast further comprises a failure protection circuit to protect said fluorescent lamp by the output of said oscillator.

5. The electronic ballast set forth in claim 4, wherein a thyristor lighting controller for said fluorescent lamp is connected serially between any one input terminal of said fluorescent lamp and the commercial power input.

6. The electronic ballast set forth in claim 1 wherein the ballast further comprises a filter connected between the commercial power input and said rectifier for filtering and isolating.

* * * * *